US005860322A

United States Patent [19]

Grabscheid et al.

[11] Patent Number: 5,860,322

[45] Date of Patent: Jan. 19, 1999

[54] DRIVE MECHANISM OF A SUCTION ROLL INCLUDING A SPUR WHEEL GEAR AND AN OUTWARD MOUNTING PORTION FOR A STATIONARY SUCTION BOX

[75] Inventors: Joachim Grabscheid, Heuchlingen; Christian Schiel, Heidenheim, both of Germany; Wilhelm Mausser; Adolf Gogg, both of Graz, Austria

[73] Assignee: Voith Sulzer Papiermaschinen, Heidenheim, Germany

[21] Appl. No.: 803,154

[22] Filed: Feb. 19, 1997

[30] Foreign Application Priority Data

Feb. 19, 1996 [AT] Austria ..... 296/96
Feb. 29, 1996 [DE] Germany ..... 196 07 678.1

[51] Int. Cl.[6] ..... F16H 1/06; F16C 13/06; B21B 13/02

[52] U.S. Cl. ..... 74/421 R; 100/172; 492/7

[58] Field of Search ..... 74/421 R; 100/172; 72/249; 492/7, 15

[56] References Cited

U.S. PATENT DOCUMENTS 4,676,117 6/1987 Schiel ..... 74/421 R
4,691,421 9/1987 Schiel ..... 492/7
4,829,842 5/1989 Schiel ..... 74/421 R
4,915,024 4/1990 Wanke ..... 492/7 X

FOREIGN PATENT DOCUMENTS 3804225 8/1988 Germany .

OTHER PUBLICATIONS

German Office Action.

*Primary Examiner*—Rodney H. Bonck
*Assistant Examiner*—Troy Grabow
*Attorney, Agent, or Firm*—Greenblum & Berstein, P.L.C.

[57] ABSTRACT

A drive mechanism of a suction or deflection adjustment roll having a spur wheel gear. For a suction roll, a stationary suction box may be guided outward through the drive mechanism to be coupled with a suction device. An external gear ring may be rigidly coupled to a driven or gear end of the roll to mesh with a driven pinion. The driven pinion may be driven via a drive shaft coupled to the driven pinion through a pair of enmeshed gears. The driven pinion and an end of the drive shaft coupled to the pinion may each include a self-adjusting bearing, each self-adjusting bearing being adjacently positioned and supported on a bearing journal. The self-adjusting bearing associated with the end of the drive shaft may exhibit radial play with respect to one of an inside diameter of the drive shaft or an outside diameter of the bearing journal, which may permit tilting of the pinion with respect to the bearing journal. Force transference may be improved by positioning the pair of enmeshed gears connecting the drive shaft and pinion between the adjacent self-adjusting bearings.

22 Claims, 2 Drawing Sheets

DRIVE MECHANISM OF A SUCTION ROLL INCLUDING A SPUR WHEEL GEAR AND AN OUTWARD MOUNTING PORTION FOR A STATIONARY SUCTION BOX

CROSS-REFERENCE OF RELATED APPLICATION

The present invention claims the priority under 35 U.S.C. § 119 of Austrian Patent Application No. A 296/96 filed on Feb. 19, 1996 and German Patent Application No. 196 07 678.1 filed on Feb. 29, 1996, the disclosures of which are expressly incorporated by reference herein in their entireties.

BACKGROUND OF THE INVENTION

1. Field of the Invention

The present invention relates to a spur wheel gear for a drive mechanism of a roll, e.g., a suction roll having a stationary suction box and a rotating roll jacket. The spur wheel gear may include a support bracket that supports a gear or driven end of the roll through a self-aligning (self-adjusting) bearing. The gear end may also include, when the roll is a suction roll, a mounting area for coupling an externally mounted suction device to the stationary suction box. The gear end of the roll may be rigidly coupled to an external gear ring that meshes with the drivable pinion driven by a laterally positioned drive shaft. The pinion may engage a first or pinion end of the drive shaft and may be supported by an additional support bearing located adjacent to another self-aligning bearing of the pinion. The additional support bearing may be permitted a predetermined amount of radial play to enable a certain degree of tilt by the pinion.

2. Discussion of Background Information

Spur wheel gears of type generally utilized in the art have been disclosed in, e.g., DE 38 04 225 A1. Known roll types, e.g., deflection adjustment rolls or suction rolls, as utilized in the paper industry, e.g., in water removal presses, glazing rollers, in tissue machines, and the like. Rolls of this kind have a roll jacket that is rotatable around a stationary carrier and/or a stationary suction box.

When rolls of the type discussed above are in operation, if the roll jacket bends under the load, then an external gear ring coupled to the roll jacket, along with an end region of the roll jacket, inclines slightly relative to the gear housing, which cannot be inclined and which is simultaneously used as a support bracket for the entire roller.

Due to the relative tilting of the roll with respect to a pinion, inclination of the external gear ring leads to an edge carrying of the gearing on both sides. This could be avoided by supporting the pinion in the gear housing so that the engagement line of the gearing with the external gear ring runs perpendicular to the bending direction of the roller jacket. However, this condition is difficult to precisely maintain, and moreover, is difficult to maintain for only one respective rotation direction of the roll jacket. Furthermore, the embodiment of the bearing housing would be limited.

In the general spur wheel gear discussed above, the pinion is supported on ball bearings. The tooth flanks, therefore, rest against one another without edge carrying along a common flank line, in accordance with the normal force to be transmitted, and a position of the pinion with respect to the bending direction of the roll jacket can be predefined.

However, a degree of freedom of the pinion must still be limited. Specifically, tilting of the pinion around a central axis of the pinion, i.e., parallel to an engagement line, due to a frictional moment produced by an offset of the pinion axis with respect to the shaft axis driving the pinion. In the prior art spur wheel gear, the tilting occurs through an additional support bearing, provided next to a self-aligning bearing of the pinion, that allows radial play in relation to the pinion so that the pinion tilts into a definite position. The tilting reduces common flank lines, and the linear contact of the tooth flanks turns into a point contact. In this manner, a ball-shaped quality is given to the tooth flanks in a practical manner by a kinematic effect.

The ball shape of the tooth flanks has the advantage of reducing a diagonal load distribution having a high edge compression and limiting the transferrable moment. However, it can only be small since the transferrable power otherwise drops. Thus, the radial play is only selected to be small.

However, a problem occurs in that, due to the additional support bearing next to the self-aligning bearing of the pinion, the spacing of the coupling between the drive shaft and the pinion from the central plane of the self-aligning bearing of the pinion is relatively large. This relatively large spacing causes a diagonal load distribution on the tooth flanks of the pinion since the friction in the geared coupling between the pinion and the pinion drive shaft produces relatively high reaction moments and reaction forces, which are partially supported on the meshing tooth flanks of the pinion.

Further, the pinion tilt occurring during the operation of the roll produces a comparatively large additional deflection of the coupling between the drive shaft and the pinion. When the drive shaft includes a coupling shaft between the pinion and a drive sleeve driven by the roller drive, this additionally results in a relatively large difference of the bending angle of the coupling between the coupling roller and the pinion and between the coupling shaft and the drive sleeve.

When the roll is a suction roll, e.g., generally employed in tissue machines, the prior art devices utilize a complicated routing of a suction line. For example, because the suction occurs on the operator end of the suction roll, i.e., the end opposite the gear end, a number of reroutings are required along with the routing of the pipes to the drive end.

Further, suction rolls generally require a significant number of parts, e.g., an internal bearing and a pipeline through the machine. Further, known suction rolls require a bearing and a suction head on an operator end of the suction roll, as well as bulky collecting conduits.

SUMMARY OF THE INVENTION

An object of the present invention is to provide an improved spur wheel gear that overcomes that the aforementioned drawbacks of the prior art. In particular, a load distribution on the tooth flanks of a pinion may be improved and a bending angle between a drive shaft and a coupling may be reduced to equalize (even out) a force distribution over a width of the tooth and to increase the transferrable power. The spur wheel gear of the present invention may include a recess at an end of the drive shaft oriented toward the pinion and an additional support bearing of the pinion may be accommodated in the recess of the drive shaft.

Locating an additional support bearing on an inside of the drive shaft may eliminate a corresponding space requirement in the pinion so that the drive shaft can be positioned closer to a self-aligning (self-adjusting) bearing of the pinion. Accordingly, a coupling between the drive shaft and the pinion may have a smaller spacing from a central plane of the self-aligning bearing of the pinion. The reaction moments and reaction forces may be smaller and a more even load distribution on the tooth flanks of the pinion may be produced. The coupling between the drive shaft and the pinion may be disposed directly adjacent to a self-adjusting bearing of the pinion.

Further, the spur wheel gear according to the present invention may include that the reaction forces occurring at the coupling between the drive shaft and the pinion can be at least partially absorbed and compensated for by the additional support bearing disposed in the drive shaft. This also evens out the load distribution on the tooth flanks of the pinion. The small spacing of the coupling between the drive shaft and the pinion from the self-adjusting bearing of the pinion reduces the deflection of the coupling and also reduces the difference between the deflection of the coupling between the pinion and a drive shaft embodied as a coupling shaft, and between the coupling shaft and the drive sleeve driven by the roll drive. As a result, the two couplings can be designed for higher loads while having the same structural size.

The pinion drive shaft can be coupled directly to the pinion so that a flange required by the prior art may be eliminated. Accordingly, the moment of inertia of the pinion may be reduced and its critical speed may be increased. As a result, the power limit of the gear according to the present invention may be increased relative to the known gear.

An embodiment of the present invention may include positioning a self-adjusting bearing of the pinion and an additional support bearing on a common bearing journal that rests within the support bracket. The additional support bearing, e.g., a self-adjusting bearing, enables radial play provided between an outer ring of the self-adjusting bearing and an inner diameter of the drive shaft or, alternatively, between an inner ring of the self-adjusting bearing and an outer diameter of the bearing journal. Alternatively, a sleeve may be utilized that may be compression fit into position in the inner ring of the self-adjusting bearing. The play may then occur between the sleeve and the outer diameter of the bearing journal.

The spur wheel gear according to the present invention may be utilized with a roll, e.g., a suction roll or a deflection adjustment roll, which is embodied as a hollow roll and with which a self-adjusting bearing of the roll may be disposed essentially centrally, inside an external gear ring. Accordingly, the external gear ring may only tilt around its center point when the roll jacket is loaded, and the spacing of the external gear ring axis from the pinion axis does not change.

When the present invention is utilized with a suction roll, a further object of the present invention is to provide a gear end of the suction roll that outwardly guides the stationary suction box. The guidance of the suction box and, thus, the suction conduit through the bearing enables direct suction to occur in the roll axis. This arrangement eliminates costly structures to be utilized inside the suction roll, e.g., internal bearings of the suction box. The present invention may also simplify construction with regard to design and manufacture, simplify maintenance and operation of the system, and reduce the susceptibility of the suction roll to malfunction. This embodiment also permits the realization of a compact construction of the suction roller with the drive.

Accordingly, the present invention may be directed to a spur wheel gear for a drive mechanism of a roll. The spur wheel gear may include an external gear ring rigidly coupled to a gear end of a roll; a first self-adjusting bearing; and a support bracket. The external gear ring may be supported on the support bracket through the first self-adjusting bearing. The spur wheel gear may also include a pinion, having a hollow body, that drives the external gear ring; and a second self-adjusting bearing, such that the pinion may be supported on the support bracket by the second self adjusting bearing. A drive shaft may rotatably drive the pinion and may include a pinion end that couples the pinion and the drive shaft. The spur wheel gear may also include a third self adjusting bearing, located adjacent the second self adjusting bearing, supported on the support bracket and radially movable to tilt the pinion within a predetermined range. The pinion end may include a recess and the third self-adjusting bearing may be located within the recess.

In accordance with another feature of the present invention, the coupling of the drive shaft and the pinion may include a pair of enmeshed toothed gears, positioned adjacent the second self-adjusting bearing.

In accordance with another feature of the present invention, the drive shaft may be directly coupled to the pinion.

In accordance with still another feature of the present invention, the pinion end may include an external gearing; and the pinion may include an internal gearing engagable with the external gearing.

In accordance with a further feature of the present invention, the second self-adjusting bearing and the third self-adjusting bearing may be adjacently positioned on a common bearing journal coupled to the support bracket.

In accordance with a still further feature of the present invention, the radial movement may occur between an outer ring of the third self-adjusting bearing and an inner diameter of the recess. Alternatively, the radial movement may occur between an inner ring of the third self-adjusting bearing and an outer diameter of the bearing journal.

In accordance with yet another feature of the present invention, the roll may include a hollow roll and the first self-adjusting bearing may be coaxially positioned within the external gear ring.

In accordance with a further feature of the present invention, the roll may include a deflection adjustment roll. Alternatively, the roll may include a suction roll. The suction roll may include a stationary suction box having a suction mounting portion located at the gear end.

The present invention may also be directed to a suction roll assembly including a suction roll having a stationary suction box. The suction roll assembly may include an external gear coupled to a driven end of the suction roll; a drive shaft having a recessed portion located at a first end; a self-aligning bearing coaxially located within the recessed portion; a pinion, having a self-adjusting bearing, coupled to the external gear; a connector, coupling the pinion to the first end of the drive shaft, located between the self-aligning bearing and the self-adjusting bearing.

In accordance with another feature of the present invention, the suction roll assembly may also include a bearing journal supporting the self-aligning bearing and the self-adjusting bearing; and the self-aligning bearing may be radially movable with respect to the bearing journal. The radial movement may tilt the pinion with respect to the bearing journal.

In accordance with still another feature of the present invention, the suction roll assembly may also include a second self-aligning bearing. The second self-aligning bearing may be coaxially positioned with the external gear.

In accordance with a further feature of the present invention, the suction roll assembly may further include a mounting portion, located at the driven end of the suction roll, to couple a suction device to the stationary suction box.

In accordance with yet another feature of the present invention, air suctioned from the stationary suction box may be guided toward the driven end of the suction roll and expelled.

In accordance with still another feature of the present invention, the connector may include a pair of enmeshed gears including a first gear coupled to an outer periphery of the first end of the drive shaft and a second gear coupled to an inner portion of the pinion. Further, the second gear may be located adjacent the self-adjusting bearing. The suction roll assembly may also include a drive pin; a drive sleeve coupled to an end of the drive pin; and a second connector, coupling the drive sleeve to the drive shaft, including a pair of enmeshed gears having a first gear coupled to an outer periphery of a second end of the drive shaft and a second gear coupled to an inner portion of the drive sleeve.

In accordance with a further feature of the present invention, the suction roll assembly may further include a bearing journal supporting the self-aligning bearing and the self-adjusting bearing. The drive shaft may be coupled to, and radially movable with respect to, the bearing journal. Further, the radial movement of the drive shaft with respect to the bearing journal may produce a tilting of the pinion with respect to the bearing journal.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention may be embodied in practice.

Figure 1:
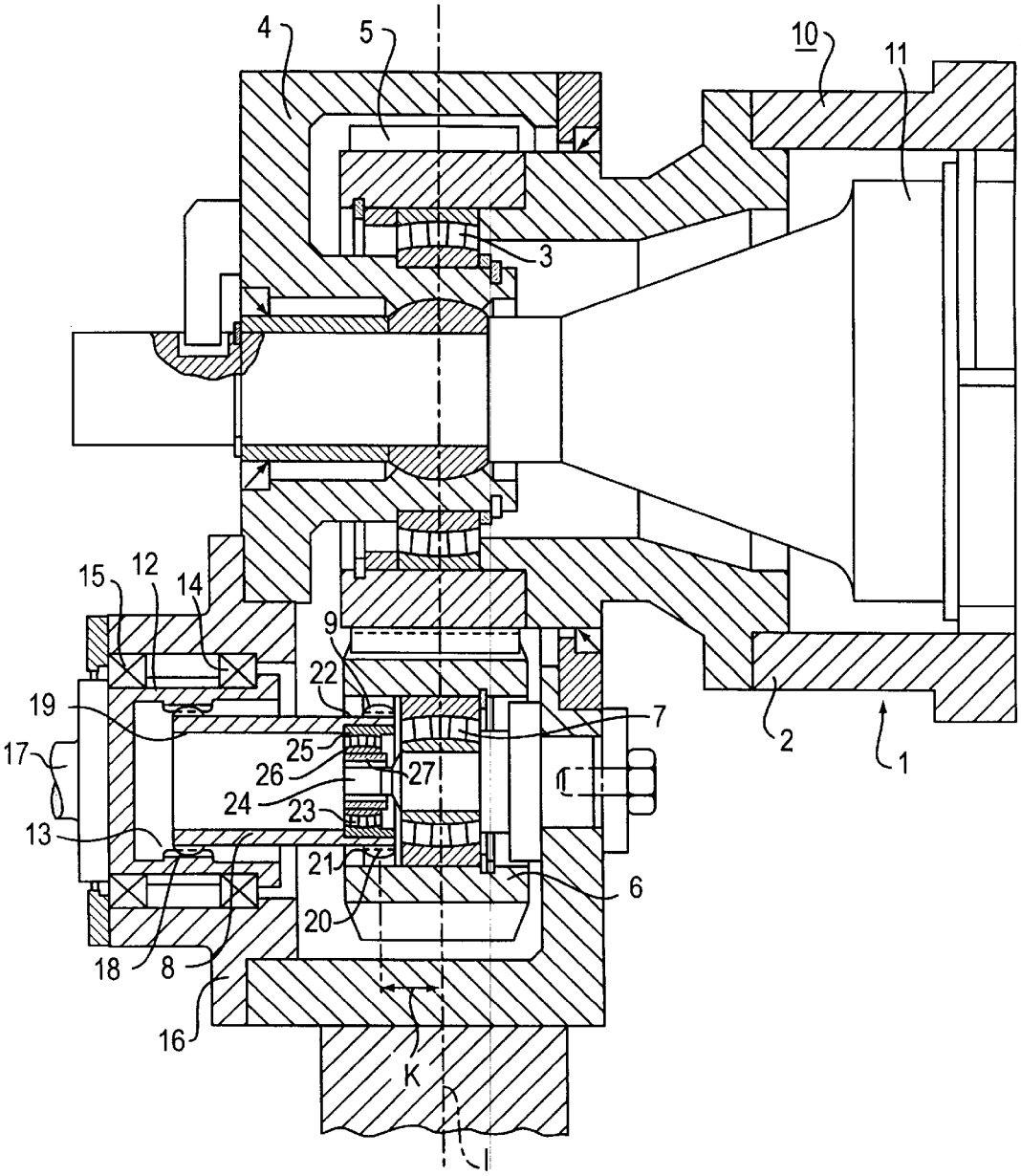
FIG. 1 illustrates a schematic sectional representation of a spur wheel gear located at a gear end of a roll.

FIG. 1 illustrates a roll 1 having a first or gear end 2 having an external gear ring 5 coupled to a support bracket 4 through a supporting self-adjusting (self-aligning) bearing 3. External gear ring 5 meshes with a pinion 6 comprising a hollow body supported on support bracket 4 through a self-adjusting bearing 7, driven by a coupling shaft 8 having a pinion end 9 oriented toward, and adjacent to, pinion 6. Pinion 6 may be coupled to coupling shaft 8 at pinion end 9. Roll 1 may include a hollow roll jacket 10 that may be rotatably rotated around a stationary carrier 11 supported by support bracket 4.

Figure 2:
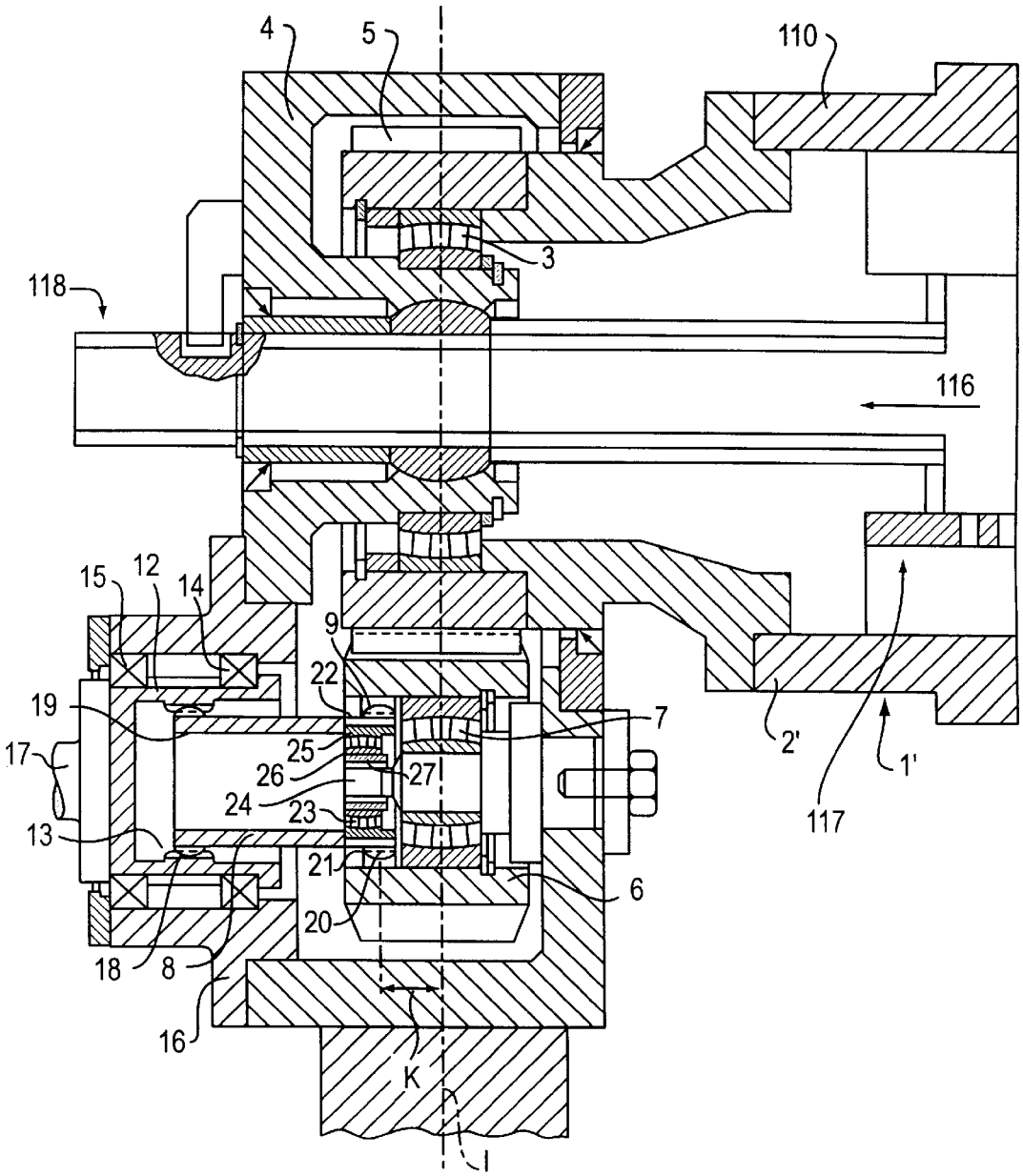
FIG. 2 illustrates a schematic sectional representation of a spur wheel gear utilized in a suction roll in accordance with the present invention.

In an alternative embodiment shown in FIG. 2, roll 1' may comprise a suction roll that may include a stationary suction box 117 and a rotating roll jacket 110 which do not require an internal support bearing. In accordance with the this embodiment, the air may be conveyed out of suction roll 1' in a direction 116, i.e. toward the first or gear end 2', by a hollow roll pin 118 that may be easily coupled to a vacuum pump (not shown) at the driven end of roll 1'. The driving of roll 1' may be carried out in the same manner as that of roll 1.

Coupling shaft 8 may be located within a drive sleeve 12, having internal gearing 13, supported by a pair of roller bearings 14 and 15 in a bearing shell 16 of support bracket 4. Drive sleeve 12 may be rotatably driven by a drive pin 17. The internal gearing 13 meshes with an external gearing 18 located at an end 19 of coupling shaft 8, i.e., opposite pinion end 9. Accordingly, rotation of drive pin 17 may be transmitted to coupling shaft 8 via the gear connection 13, 18 at end 19. Coupling shaft 8 may also include external gearing 20 located at the pinion end 9 to mesh with an internal gearing 21 of pinion 6. Thus, rotation of drive pin 17 may transmitted rotational movement to pinion 6 through coupling shaft 8. Internal gearing 21 of pinion 6 may be disposed directly adjacent to self-adjusting bearing 7, which may be centrally and substantially coaxially located within pinion 6, so that coupling shaft 8 may positioned laterally adjacent to self-adjusting bearing 7.

Coupling shaft 8 may comprise a hollow shaft having a recess 22 along an inside diameter at pinion end 9, i.e., recess 22 may be oriented toward, and adjacent to, pinion 6. A self-adjusting bearing 23 may be located within recess 22 and may be supported on a bearing journal 24. Bearing journal 24 may be coupled to support bracket 4 and may also support self-adjusting bearing 7. Self-adjusting bearing 23 may, therefore, be utilized as a support bearing for pinion 6 and counteract tilting of pinion 6.

Radial play may occur between an outer ring 25 of self-adjusting bearing 23 and an inner circumference of coupling shaft 8 (i.e., recess 22) or between an inner ring 26 of self-adjusting bearing 23 and an outer circumference of bearing journal 24. The radial play may enable a predetermined amount of tilt by pinion 6. Alternatively, a sleeve 27 may be compression fit within inner ring 26. An inner diameter of sleeve 27 may be greater than an outer diameter of bearing journal 24 by a predetermined desired amount. Therefore, pinion 6 may rotate around an axis perpendicular to an engagement line I of the gearing with external gear ring 5, in accordance with the normal force to be transmitted. Due to an axis offset between the coupling shaft 8 and pinion 6, and due to the moment of friction produced by this axis offset, pinion 6 may further tilt with respect to bearing journal 24 or an axis parallel to engagement line I, i.e., provided play amount permits it, so that a definite position of pinion 6 may be produced, in which a ball-shape of the pinion gearing is kinematically reproduced.

At the coupling point between pinion 6 and coupling shaft 8, i.e., enmeshed gears 20 and 21, pinion 6 may tilt relative to coupling (drive) shaft 8. A slight spacing k may be formed between central plane I of self adjusting bearing 7 and the coupling point of coupling shaft 8 and pinion 6. Spacing k, due to its slight distance may only enable a relatively small inclination of pinion 6 with respect to coupling shaft 8.

Coupling point gears 20 and 21, which couple coupling shaft 8 to pinion 6 may be preferably located between self-adjusting bearing 7 and self-adjusting bearing 23. As a result, spacing k between coupling point gears 20 and 21 and central plane I may be minimized. Further, coupling shaft 8 may be directly coupled to pinion 6. Therefore, pinion 6 may have few parts and may have a low moment of inertia. As a result, in addition to a favorable load distribution onto tooth flanks of pinion 6, a high critical speed of pinion 6 may be produced.

The favorable load distribution may be additionally benefitted in that the coupling forces between pinion 6 and coupling shaft 8 are at least partially compensated for by self-adjusting bearing 23 within coupling shaft 8. Due to the proximity of coupling point gears 20 and 21 to central plane I, a bending angle between pinion 6 and coupling shaft 8, and a bending angle between coupling shaft 8 and drive sleeve 12, may also be small. Thus, a spur wheel gear with a very favorable transference of force onto roll jacket 10 may be obtained. In addition to a high efficiency, this also produces a reduced wear and tear.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. For example, the present invention may utilize a higher or lower number of press gaps depending on the specific need.

REFERENCE NUMERAL LIST

1 roll
2 gear (driven) end of roll
3 self-adjusting bearing
4 support bracket
5 external gearing
6 pinion
7 self-adjusting bearing
8 coupling shaft
9 pinion (first) end of coupling shaft
10 roll jacket
11 carrier
12 drive sleeve
13 internal gearing
14 roller bearing
15 roller bearing
16 bearing shell
17 drive pin
18 external gearing
19 end of 8 remote from the pinion
20 external gearing
21 internal gearing
22 recess
23 self-adjusting bearing
24 bearing journal
25 outer ring
26 inner ring
27 sleeve
I central plane of 7
k spacing
1' suction roll
110 roll jacket
116 direction of suctioned air flow
117 stationary suction box
118 hollow roll pin to mount external suction device

What is claimed is:

1. A spur wheel gear for a drive mechanism of a roll, said spur wheel gear comprising:

an external gear ring rigidly coupled to a gear end of a roll;

a first self-adjusting bearing;

a support bracket;

the external gear ring supported on the support bracket through the first self-adjusting bearing;

a pinion, having a hollow body, that drives the external gear ring;

a second self-adjusting bearing;

the pinion supported on the support bracket by the second self-adjusting bearing;

a drive shaft that rotatably drives the pinion, the drive shaft including a pinion end that couples the pinion and the drive shaft;

a support bearing, located adjacent the second self-adjusting bearing, supported on the support bracket and radially movable to tilt the pinion within a predetermined range; and the pinion end comprising a recess and the support bearing being located within the recess.

2. The spur wheel gear according to claim 1, the coupling of the drive shaft and the pinion, which comprises a pair of enmeshed toothed gears, positioned adjacent the second self-adjusting bearing.

3. The spur wheel gear according to claim 1, the drive shaft being directly coupled to the pinion.

4. The spur wheel gear according to claim 1, the pinion end comprising an external gearing; and the pinion comprising an internal gearing engagable with the external gearing.

5. The spur wheel gear according to claim 1, the second self-adjusting bearing and the support bearing adjacently positioned on a common bearing journal coupled to the support bracket.

6. The spur wheel gear according to claim 1, the support bearing comprising a third self-aligning bearing.

7. The spur wheel gear according to claim 1, the radial movement occurring between an outer ring of the support bearing and an inner diameter of the recess.

8. The spur wheel gear according to claim 1, the second self-adjusting bearing and the support bearing being adjacently positioned on a bearing journal; and the radial movement occurring between an inner ring of the support bearing and an outer diameter of the bearing journal.

9. The spur wheel gear according to claim 1, the roll comprising a hollow roll and the first self-adjusting bearing is coaxially positioned within the external gear ring.

10. The spur wheel gear according to claim 1, the roll comprising a deflection adjustment roll.

11. The spur wheel gear according to claim 1, the roll comprising a suction roll.

12. The spur wheel gear according to claim 11, the suction roll comprising a stationary suction box having a suction mounting portion located at the gear end.

13. A suction roll assembly including a suction roll having a stationary suction box, said suction roll assembly comprising:

an external gear coupled to a driven end of the suction roll;

a drive shaft having a recessed portion located at a first end;

a self-aligning bearing coaxially located within the recessed portion;

a pinion, having a self-adjusting bearing, coupled to said external gear;

a connector that couples said pinion to said first end of said drive shaft; and said connector located between said self-aligning bearing and said self-adjusting bearing.

14. The suction roll assembly according to claim 13, further comprising:

a bearing journal supporting said self-aligning bearing and said self-adjusting bearing; and said self-aligning bearing being radially movable with respect to said bearing journal, the radial movement tilting said pinion with respect to said bearing journal.

15. The suction roll assembly according to claim 13, further comprising a second self-aligning bearing, said second self-aligning bearing being coaxially positioned with said external gear.

16. The suction roll assembly according to claim 13, further comprising a mounting portion, located at said driven end of the suction roll, to couple a suction device to the stationary suction box.

17. The suction roll assembly according to claim 16, wherein suctioned air from the stationary suction box is guided toward the driven end of the suction roll and expelled.

18. The suction roll assembly according to claim 13, said connector comprising a pair of enmeshed gears including a first gear coupled to an outer periphery of said first end of said drive shaft and a second gear coupled to an inner portion of said pinion.

19. The suction roll assembly according to claim 18, said second gear located adjacent said self-adjusting bearing.

20. The suction roll assembly according to claim 18, further comprising:

a drive pin;

a drive sleeve coupled to an end of said drive pin; and a second connector, coupling said drive sleeve to said drive shaft, comprising a pair of enmeshed gears including a first gear coupled to an outer periphery of a second end of said drive shaft and a second gear coupled to an inner portion of said drive sleeve.

21. The suction roll assembly according to claim 13, further comprising:

a bearing journal supporting said self-aligning bearing and said self-adjusting bearing; and said drive shaft coupled to, and radially movable with respect to, said bearing journal.

22. The suction roll assembly according to claim 21, the radial movement of the drive shaft with respect to the bearing journal producing a tilting of the pinion with respect to the bearing journal.

* * * * *